US006581244B1

(12) United States Patent
Peters

(10) Patent No.: US 6,581,244 B1
(45) Date of Patent: Jun. 24, 2003

(54) HINGE CONSTRUCTION, ESPECIALLY FOR ITEMS OF JEWELLERY

(75) Inventor: John Peters, Hockley (GB)

(73) Assignee: Abbeycrest PLC, Leeds (GB)

( * ) Notice: Subject to any disclaimer, the term of this patent is extended or adjusted under 35 U.S.C. 154(b) by 0 days.

(21) Appl. No.: 09/762,499

(22) PCT Filed: Aug. 5, 1999

(86) PCT No.: PCT/GB99/02345

§ 371 (c)(1),
(2), (4) Date: Mar. 27, 2001

(87) PCT Pub. No.: WO00/07480

PCT Pub. Date: Feb. 17, 2000

(30) Foreign Application Priority Data

Aug. 7, 1998 (GB) ..... 9817220

(51) Int. Cl.[7] ..... E05D 5/10

(52) U.S. Cl. ..... 16/386; 16/267; 29/11; 63/12

(58) Field of Search ..... 16/386, 266, 267, 16/268; 29/11; 63/12

(56) References Cited

U.S. PATENT DOCUMENTS

| | | | | | |
|---|---|---|---|---|---|
| 285,231 | A | * | 9/1883 | Clark | |
| 376,597 | A | * | 1/1888 | Hoffman, Jr. | |
| 1,139,309 | A | * | 5/1915 | Nesler | |
| 1,289,189 | A | * | 12/1918 | King | |
| 2,605,926 | A | * | 8/1952 | Casey | |
| 2,645,841 | A | * | 7/1953 | Bevens | |
| 2,647,379 | A | * | 8/1953 | Ferro | |
| 2,732,581 | A | * | 1/1956 | Heck | |
| 2,931,195 | A | | 4/1960 | Laflamme | |
| 3,033,010 | A | | 5/1962 | Pintarelli | |
| 3,208,239 | A | * | 9/1965 | Pintarelli | |
| 3,333,726 | A | * | 8/1967 | Belanger | |
| 3,471,874 | A | * | 10/1969 | Dixon | |
| 4,003,217 | A | * | 1/1977 | Evans et al. | 63/12 |
| 4,089,189 | A | * | 5/1978 | Verducci | 63/12 |
| 4,153,347 | A | * | 5/1979 | Myer | |
| 4,299,241 | A | * | 11/1981 | Seiller Pierre F. X. | 132/48 R |
| 4,329,758 | A | | 5/1982 | Fohl | |
| 4,379,360 | A | * | 4/1983 | Papsdorf | 29/11 |
| 5,761,928 | A | | 6/1998 | Silveri | |

FOREIGN PATENT DOCUMENTS

| | | |
|---|---|---|
| GB | 2 249 708 A | 5/1992 |

* cited by examiner

*Primary Examiner*—Anthony Knight
*Assistant Examiner*—Alison K. Pickard
(74) *Attorney, Agent, or Firm*—Woodward, Emhardt, Moriarty, McNett & Henry LLP

(57) ABSTRACT

A method and hinge construction for mounting to an item, such as, jewelry. An H-shaped mounting plate has two support legs for mounting to the item. The plate has a hinge pin pivotally receiving the Y-shaped end of a hinge component with the opposite end of the component securable to a clasp plate mounted to the item.

12 Claims, 4 Drawing Sheets

HINGE CONSTRUCTION, ESPECIALLY FOR ITEMS OF JEWELLERY

BACKGROUND OF THE INVENTION

1. Field of the Invention

This invention relates to hinge constructions, especially for items of jewellery of precious metals or their alloys. The invention may be applicable more generally, but it was devised in connection with the manufacture of items of jewellery, in particular items of jewellery known as creole earrings.

Therefore, in the following reference is made mainly to creole earrings, as such reference: best explains the nature of the invention, but it is to be borne in mind that it may have application in other fields, and the applicants do not wish to be prevented from coverage of the invention in such other fields. It must be stated however, that having regard to the nature of the invention, it has particular advantage and application in the field of items of jewellery which have hinge constructions of a delicate nature, and of a relatively small size. In other fields, where hinges are more robust and are of greater dimension, the advantages of the invention may not be as great.

2. Description of Related Art

A creole earring comprises basically a looped body of part round, oval or other shape defining two ends which are adjacent, but are bridged by a hinge bar or hasp which passes through the user's ear. The hinge bar is hinged to a hinge pin at one end of the body, and may be a stamping with a hole therein through which the pin passes, or a length of wire bent to shape around the pin. On the other end of the body is a clasp into or onto which the hinge clips. On the end where the hinge bar hinges, there is a U-shaped mounting bracket formed from a plate pressing and which is soldered or brazed to the body, and the bracket carries the hinge pin on which the hinge bar is pivotally mounted.

Such earrings each comprise six components, namely two body halves which are soldered or brazed together to form the body, the mounting bracket, the clasp, the hinge pin and the hinge bar.

Such earrings are notoriously difficult to make mainly because of the size, and typically are entirely hand made. The difficulties include that i) it is difficult to locate the hinge pin in the hole of the hinge bar when such bar is a plate pressing, and it is difficult to form the wire around the hinge pin when the hinge bar is of wire ii) the pin, which is of the order of 10–20 thousandths of an inch in diameter, is cut (usually with hand operated wire cutters) from wire and it may have burrs or flashings on the ends which have to be removed, and is difficult to handle, and after it has been inserted in the bracket and is engaged by the hinge bar, has to be swaged at its ends to keep it in position. The pin is a weak spot in the earring, and will pull out easily, especially if the swaging is not performed perfectly, iii) the formation of the bracket from a flat plate (again of only 10–20 thousandths of an inch thickness) is a difficult operation, and if not performed perfectly, can cause difficulties in the hinge construction regarding the location of the hinge pin iv) generally, the current method of construction is slow, difficult and expensive.

The present invention, which has a number of aspects, was conceived to address the difficulties indicated above, and the various aspects overcome, at least in part, the aforesaid problems.

BRIEF SUMMARY OF THE INVENTION

According to the invention, in a first aspect, there is provided a method of forming a hinge comprising a hinge component which is hinged to a hinge pin, and in which method a hinge component is attached to the hinge pin to pivot thereon by having a portion of Y-shape, and the attachment is by positioning the pin between the arms of the Y-shape, followed by the bending of at least one of the arms around the pin so that it will be retained by the arms enabling the component to hinge on the pin.

This method provides that the attachment of the component to the pin is simplified, as compared to the conventional method described above, in that there is no aligning of pin and hole, and nor is there any need to form a wire member around the hinge pin.

Preferably, both arms of the Y-shape may be bent around the pin to the same extent, and also the extremities of the arms may be shaped to be complimentary to each other, so that they abut and neatly inter-fit when bent around the pin. For example, if one end has a convex shape, the other end may be concave. The ends may alternatively be squared off, or cut on an angle. Another alternative is that the ends may overlap after the bending, but in the case of fine jewellery, this is not preferred.

Such a hinge construction can easily be made strong by making the Y-shaped end of sufficient robustness and thickness. This is easily achievable in the case of delicate items of jewellery.

As will be understood, it is preferred that the method be applied to a creole earring, and the said component is the hinge bar, which at the other end is adapted to engage the clasp in the conventional way.

The component is preferably a stamping from sheet material, such as a precious metal or its alloys, which does not require any additional processing before being applied to the hinge pin.

In jewellery manufacture, such a method can be effected by machinery much more readily than the conventional method, providing a main advantage of the first aspect of the invention.

In the first aspect of the invention, the hinge pin can be one of conventional configuration, mounted in a conventional bracket, as described above, but this is not preferred, and a second aspect addresses replacing the conventional hinge pin arrangement.

The second aspect of the invention may be applicable outside the field of items of jewellery, but is less likely to be so than the first aspect above.

In the second aspect of the invention, which can be in combination with or independent of the first aspect of the invention, to provide a hinge pin for a hinge in an item of jewellery, a mounting plate is provided, which has a shaped portion, such as an H-shaped portion defining a cross bar which extends between two support legs, of which the cross bar forms a hinge pin in a hinge of the item of jewellery.

With this second aspect, a wire can be used for the hinge bar or hasp, in that the wire can be bent round the cross bar to become hinged to the hinge pin, but we prefer that the first and second aspects be combined, in an item of jewellery, so that the hinge component has the Y-shaped end as discussed above, and can be applied to the mounting plate to become hinged thereto.

The second aspect of the invention provides a means of overcoming or reducing the disadvantages of using a separate hinge pin, and provides for a strong hinge easily constructed using machine techniques. It may be desirable to further form the pin to circular cross section to enhance the functioning of the hinge, but it is preferred that the stamping of the mounting plate be the only operation involved in producing the mounting plate, in which case the pin would have a square cross section. It all depends upon whether or not the hinge can be made to work smoothly with a square cross sectioned hinge pin. It is believed that such a hinge pin can be made to work smoothly in items of jewellery, especially earrings, in which loadings are small.

The mounting plate preferably has a section parallel to the cross bar and also joining the legs, which section is shaped to enable it to be connected to the body of an earring.

For the application of the aspects of the invention to items of jewellery and specifically to creole earrings, the mounting plate and the clasp are plate stampings, and additionally the body may be notched to provide locations for the stamped clasp and mounting plate, which will lie with their planes at right angles to the plane of the body. This notching of the body to provide for easy location of the clasp and/or the mounting plate forms in itself another a third aspect of the present invention which can be in combination with or independent of the first and/or second aspect of the present invention. The advantage of such notching enables the simpler locating and fixing of the clasp and/or mounting plate.

A further advantage of the invention in the first and second aspects is that by using these aspects, not only does a simpler, quicker and less expensive construction method for creole earrings result, but also the number of separate parts to make an earring is reduced due to the fact that the pin and mounting bracket are merged into a single mounting plate.

The invention also provides hinges and items of jewellery produced by the methods of the aspects of the present invention.

BRIEF DESCRIPTION OF THE DRAWINGS

An embodiment of the present invention, including its various aspects, will now be described by way of example, with reference to the accompanying diagrammatic drawings, wherein.

DETAILED DESCRIPTION OF THE INVENTION

Figure 1:
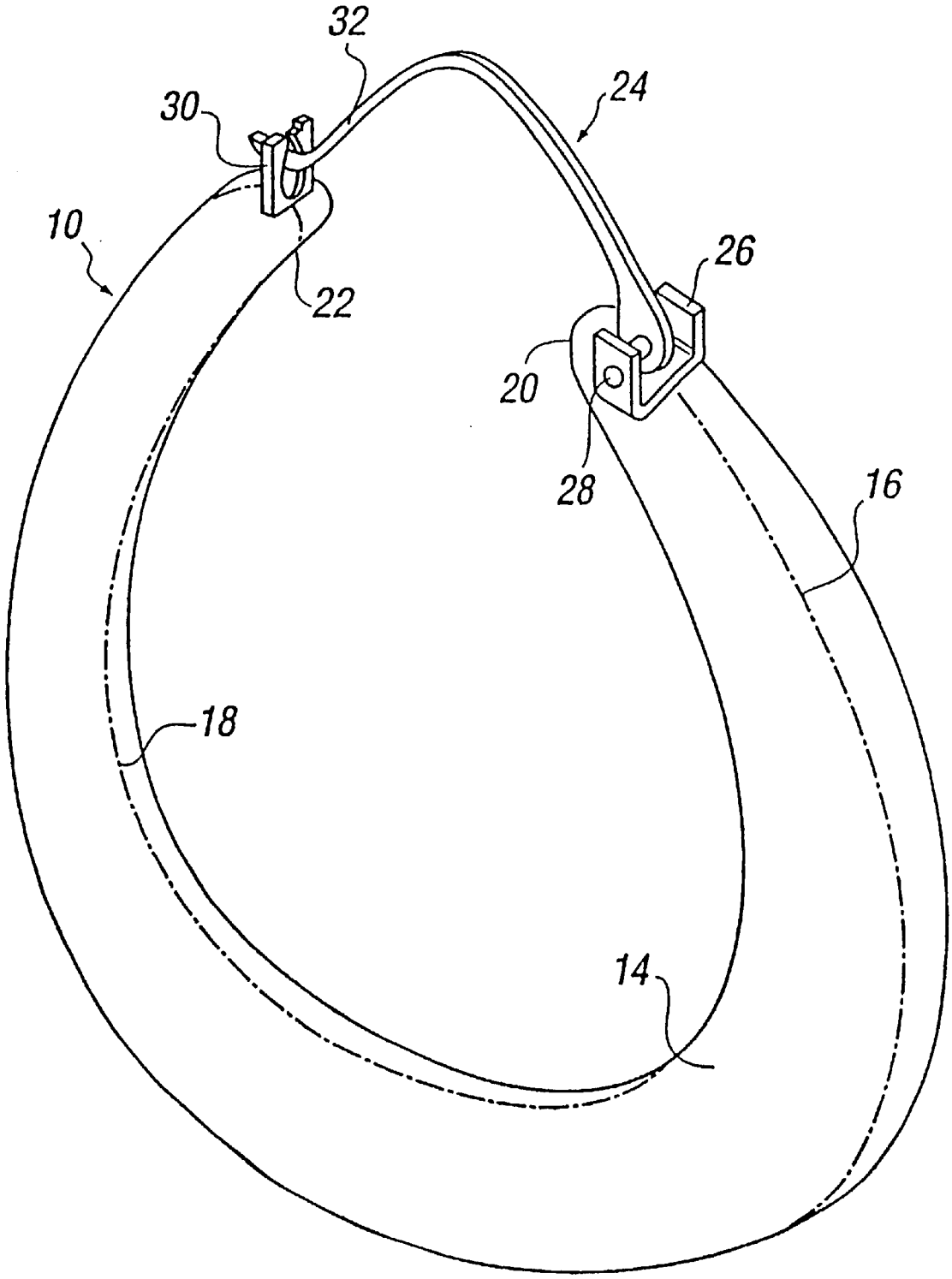
FIG 1 (PRIOR ART)
FIG. 1 is a perspective view of a creole earring of conventional construction.
Figure 2:
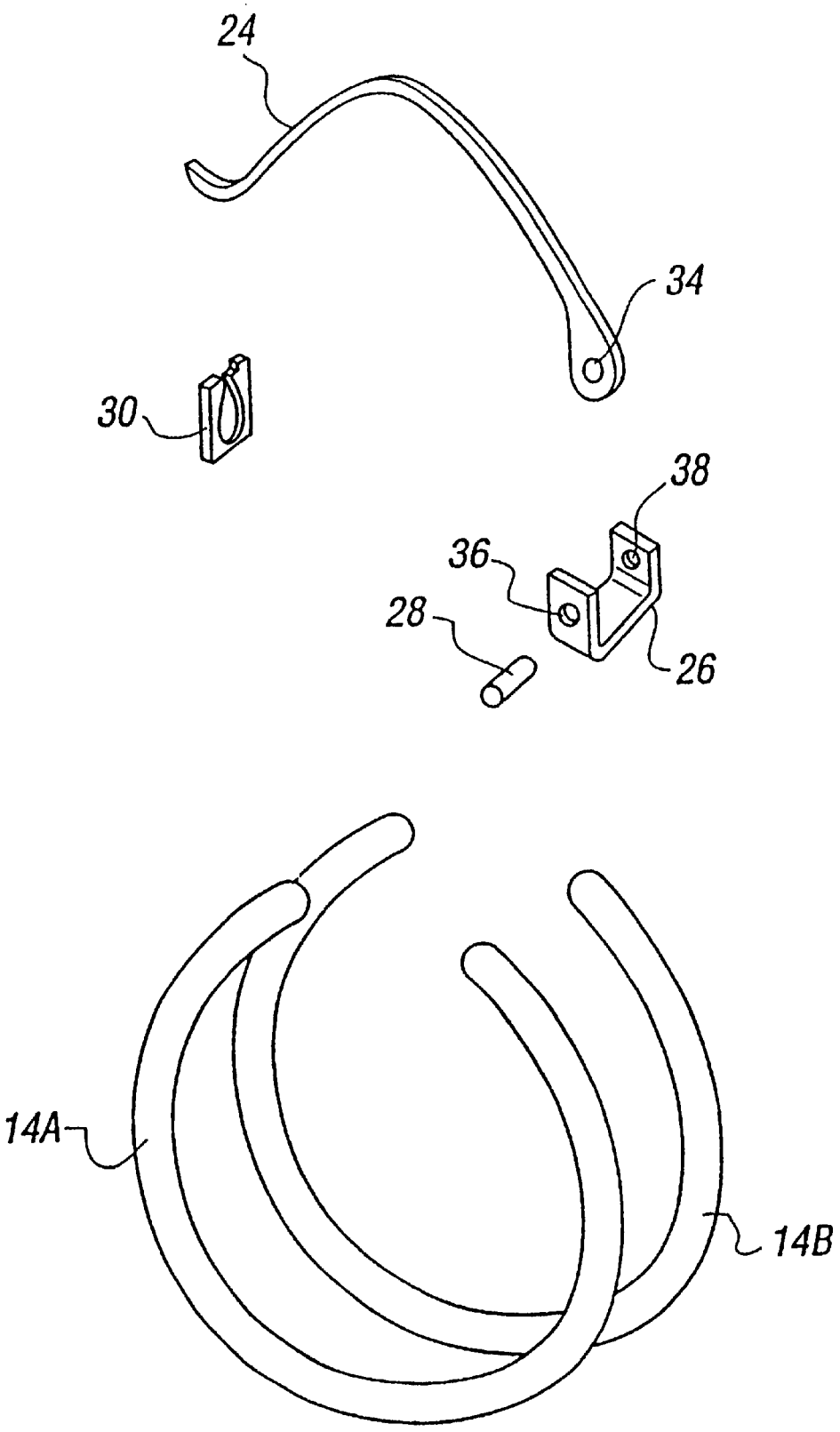
FIG 2 (PRIOR ART)
FIG. 2 is an exploded perspective view of the parts of the earring shown in FIG. 1.

Referring to the drawings in FIG. 1 a conventional creole 10 earring is shown, and will be seen to comprise a loop body 14 which is made up of two similar halves 14A and 14B as shown in FIG. 2 which are soldered or brazed together along seam lines 16 and 18.

The earring body typically will be of precious metal or an alloy of precious metal. It is to be mentioned that the earring body can take any suitable form and can be constructed of any appropriate material.

Because of the shape of the body, it defines at the top thereof two ends 20 and 22 between which is a gap bridged by the hinge bar 24 of the earring. The hinge bar 24 is supported for hinging movement at end 20 by being mounted on a plate bracket 26 through which and through the end of the hinge bar passes a hinge pin 28.

On the other end 22 is provided a clasp plate 30 which is of U-shape form, so that the free end 32 of the hinge bar 24 can be snapped into the clasp 30 to hold it in the position shown.

In the position shown in FIG. 1, the earring would normally be stored or mounted on a user's ear in which latter case the hinge bar 24 would pass through the user's earlobe.

FIG. 2 shows that the earring of FIG. 1 has six components namely the two body halves 14A and 14B, the mounting bracket 26, the hinge pin 28, the hinge bar 24 and the clasp plate 30.

The difficulties with the conventional earrings shown as mentioned herein are related to the use of a mounting bracket 26, a hinge pin 28 and the method of connecting the hinge bar 24 to the mounting bracket 26 and pin 28. Specifically, the hinge bar 24 is provided as shown in FIG. 2 at one end with an aperture 34 through which the pin 28 has to pass. In manufacturing the conventional earring, the bracket 26 first of all has to be stamped from flat plate and then folded into U-configuration. The limbs of the U-configuration are provided with apertures 36 and 38 to receive the pin 28. To assemble the bracket 26 and the hinge bar 24, the end of the hinge bar is positioned between the limbs of the bracket 26 so that the aperture 34 aligns with apertures 36 and 38, and then the hinge pin 28 is fed through these apertures. When in position, the ends are swaged over or riveted to fix the pin in position. These operations are carried out mainly manually and are difficult.

Figure 3:
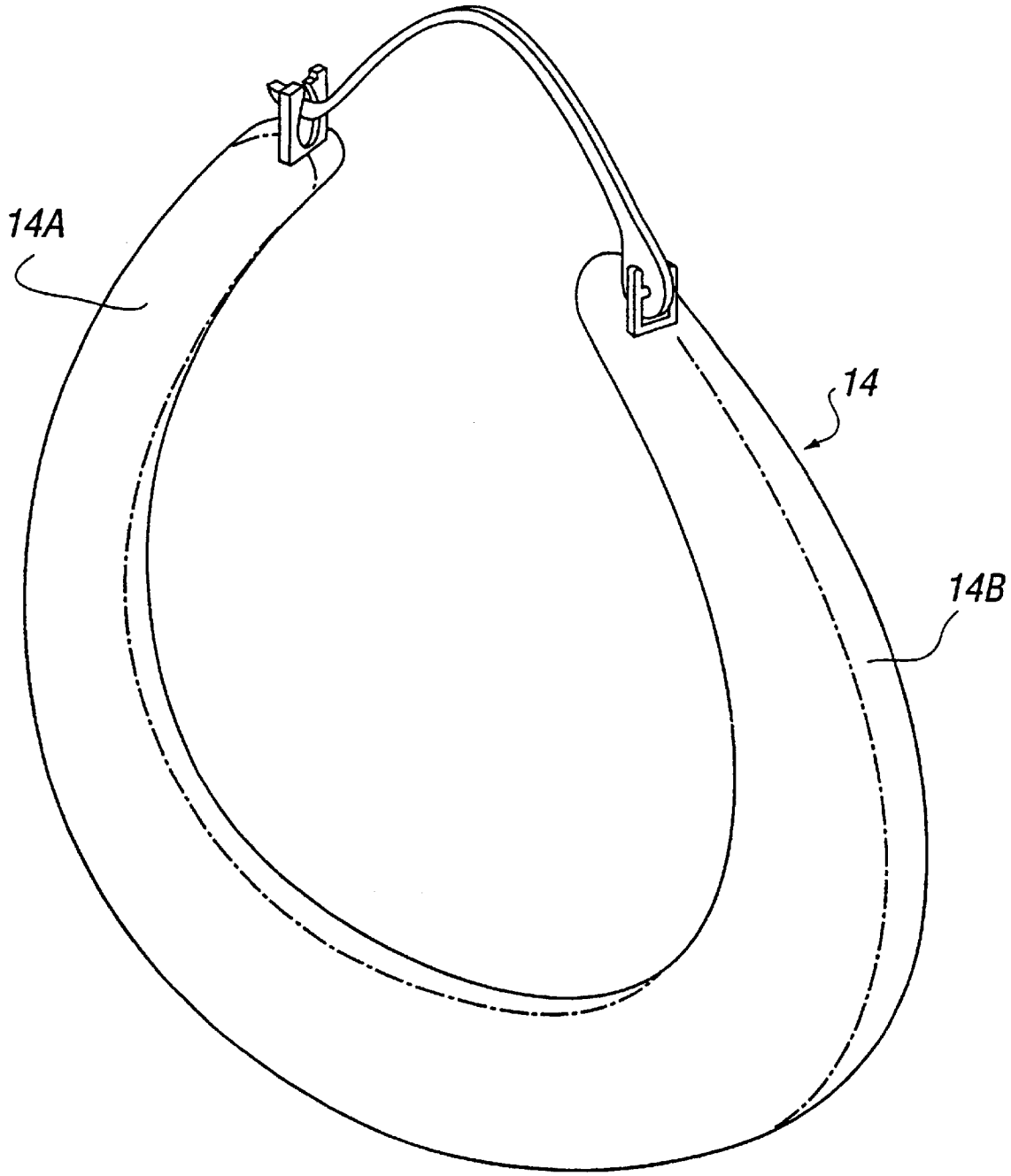
FIG. 3 is a view similar to FIG. 1 showing an earring embodying the several aspects of the present invention.
Figure 4:
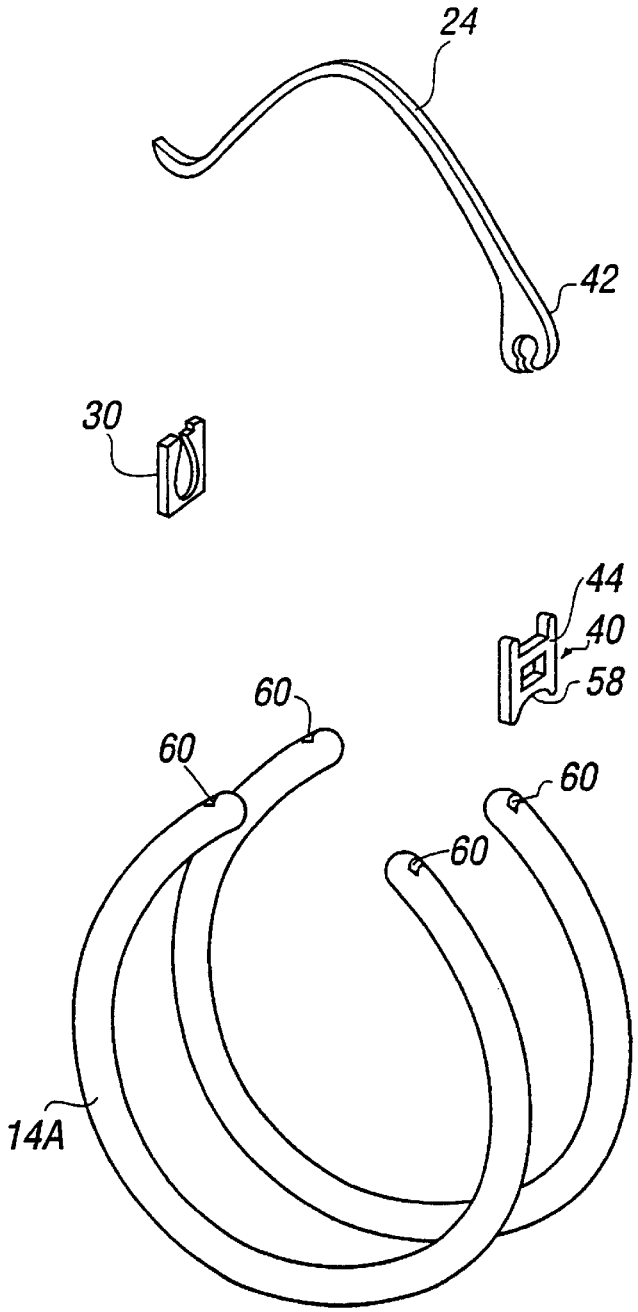
FIG. 4 is a view similar to FIG. 2, but showing the earring of FIG. 3.

Turning now to FIGS. 3 and 4 which show an earring according to the embodiments of the present invention in its various aspects, in the earring according to the invention again the body halves 14A and 14B are provided, but instead of utilising a mounting bracket 26, a mounting plate 40 which is a single stamping and of the configuration shown in FIG. 3, is used. Additionally, the end of the hinge bar 24 is modified as shown at 42 in FIG. 4 so that the end is in the form of Y-shape, shown with particularity in FIG. 5*a*.

Figure 5A:
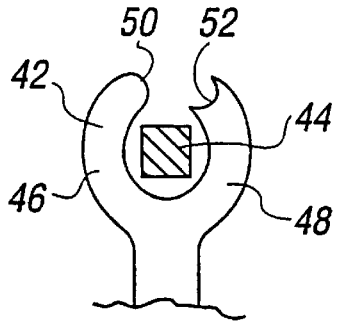
FIGS. 5*a* and 5*b* are views :showing in sequence how the hinge bar is connected to the hinge pin to form the hinge of the earring of FIG. 3.
Figure 5B:
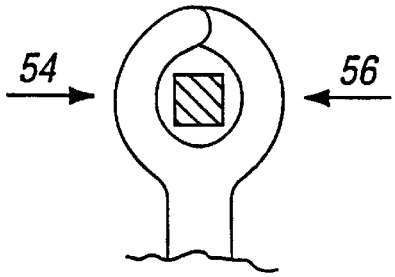

The mounting plate 40 is a single stamping, and has a portion of H-configuration and the crossbar 44 in fact forms the pivot pin in the new hinge construction. To form the hinge certain operations are performed as shown in FIGS. 5*a* and 5*b*. In FIG. 5*a* it is shown that the Y-shaped end 42 is applied in relation to the pin 44 such that the pin lies between the arms 46 and 48 of the Y-shape. At the extremities the arms 46 are respectively formed convex as shown at 50 and concave as shown at 52. The ends of the arms are spaced so that the pin 44 can pass between them. When in the position shown in FIG. 5*a*, it is simply a matter of bending the arms in the manner illustrated by arrows 54 and 56 in FIG. 5*b*, which can easily be done by a machine or a jig until the convex end 50 enters the concave end 32 as shown in FIG. 5*b*. The hinge pin 44 is trapped and the hinge is thereby simply completed. This will normally be done after the plate 40 has been attached to the body 14, but this is not essential. The clasp plate 30 is the same as the clasp plate 30 in a conventional earring. Construction has been considerably simplified, and can be effected more extensively by machine operation.

Additionally, as can be seen from FIG. 4 the number of components in the earring has now been reduced, and the production of a separate hinge pin has been completely eliminated.

The hinge pin 44 is shown as being in square cross-section which is the form it will take after the mounted plate 40 has been stamped out of sheet material, but if necessary the pin 44 can subsequently be processed in order to make it of circular cross-section, should this be necessary for the effective hinging of the hinge pin.

The lower edge portion 58 of the plate 40 may be shaped to be concave as shown so as to fit neatly onto the body end 20 to simplify connection thereto by brazing or soldering, and in a further improved aspect of the earring, the body 14 is notched as shown at 60 in FIG. 4 so as to provide a grove into which the plate pressings 30 and 40 can be positioned for location purposes and to simplify the brazing of the plates to the body. This in itself can form a separate aspect of the present invention.

It can be seen that by the various aspects of the present invention an immensely improved earring construction has been provided, and it is also to be noted that these aspects or some of them may have utilisation outside the field of jewellery.

What is claimed is:

1. A method of forming a hinge comprising a hinge pin (44) and a hinge component (24), which is hinged to the hinge pin (44), characterised in that the hinge component (24) is attached to the hinge pin (44) to pivot thereon having a portion (42) of Y-shape with arms (46, 48), and the attachment is by the step of positioning the pin (44) between the arms (46, 48) of the Y-shape, followed by the step of bending at least one of the arms (46, 48) around the pin (44) so that it will be retained by the arms (46, 48) enabling the component (24) to hinge on the pin (44), and wherein the hinge pin (44) is formed as a crossbar (44) extending between two support legs of an H-shaped portion of a mounting plate (40) the two support legs have bottom mounting ends for attachment to an item of jewelry.

2. A method according to claim 1, wherein both arms (46, 48) of the Y-shape may be bent around the pin (44) to the same extent.

3. A method according to claim 2, wherein the arms (46, 48) have extremities (50, 52) which are shaped to be complimentary to each other, so that they abut and neatly inter-fit when bent around the pin (44).

4. A method according to claim 1, wherein the component is preferably a stamping from sheet material, and does not require any additional processing before being applied to the hinge pin.

5. A method according to claim 1, including the step of attaching the bottom mounting ends of the support legs to an item of jewelry.

6. A method according to claim 5, wherein the item of jewellery is a creole earring having a clasp, and said hinge component being a hinge bar (24) which has an end opposite a hinge engaging the earring clasp (30).

7. A method of forming a hinge comprising a hinge component (24) which is hinged to a hinge pin (44), characterised in that the hinge component (24) is attached to the hinge pin (44) to pivot thereon by having a portion (42) of Y-shape, and the attachment is by positioning the pin (44) between the arms (46, 48) of the Y-shape, followed by the step of bending of at least one of the arms (46, 48) around the pin (44) so that it will be retained by the arms (46, 48) enabling the component (24) to hinge on the pin (44), and wherein both arms (46, 48) of the Y-shape may be bent around the pin (44) to the same extent, the extremities (50, 52) of the arms (46, 48) are shaped to be complimentary to each other, so that they abut and neatly inter-fit when bent around the pin (44), and wherein one extremity (50) has a convex shape, and the other (52) is concave.

8. A method of forming a hinge comprising a hinge pin (44) and a hinge component (24), which is hinged to the hinge pin (44), characterised in that the hinge component (24) is attached to the hinge pin (44) to pivot thereon by having a portion (42) of Y-shape with arms (46, 48), and the attachment is by positioning the pin (44) between the arms (46, 48) of the Y-shape, followed by the step of bending at least one of the arms (46, 48) around the pin (44) so that it will be retained by the arms (46, 48) enabling the component (24) to hinge on the pin (44), and wherein in order to provide the hinge pin (44) a mounting plate (40) is provided, and wherein the hinge is formed on an item of jewelry which has an earring body (14), and wherein the earring body (14) of the item of jewelry is notched to provide locations (60) for the hinge component (24) and the mounting plate (40), so that they lie with their planes at right angles to the plane of the body (14).

9. A hinge construction comprising:

a mounting plate, having an H-shaped portion defining a pair of legs and a hinge pin extending therebetween, said pair of legs have bottom mounting for attachment to an item of jewelry and, a hinge component attached to said pin to pivot thereon, said component having a portion of Y-shape with arms; said pin positioned between said arms with at least one of said arms bent around said pin retaining said pin and hinging said component on said pin, said arms including distal ends mateable together when at least one of said arms are bent around said pin.

10. The hinge construction of claim 9 wherein both of said arms are bent around said pin to the same extent.

11. The hinge construction of claim 9 wherein said arms have extremities shaped to be complimentary to each other so they abut and neatly inter-fit when bent around said pin.

12. A hinge construction comprising:

a hinge pin; and, a hinge component attached to said pin to pivot thereon, said component having a portion of Y-shape with arms, said pin positioned between said arms with at least one of said arms bent around said pin retaining said pin and hinging said component on said pin, and wherein both of said arms are bent around said pin to the same extent and have extremities and wherein one of said extremities has a concave shape and the other of said extremities has a convex shape.

* * * * *